US005143656A

United States Patent [19]

Marino et al.

[11] Patent Number: 5,143,656

[45] Date of Patent: Sep. 1, 1992

[54] HUMIDIFIER WITH A TAMPER PROOF LIQUID LEVEL RESPONSIVE SHUT-OFF

[75] Inventors: Frank Marino, Upton, Mass.; Johnson Peng, Chaug-Haw, Taiwan

[73] Assignee: Duracraft Corporation, Sudbury, Mass.

[21] Appl. No.: 783,738

[22] Filed: Oct. 28, 1991

[51] Int. Cl.[5] ..... B01F 3/04

[52] U.S. Cl. ..... 261/26; 261/107

[58] Field of Search ..... 261/107, 104, 99, 29, 261/26

[56] References Cited

U.S. PATENT DOCUMENTS

| | | | |
|---|---|---|---|
| 310,116 | 12/1884 | Beale | 261/104 |
| 1,664,671 | 4/1928 | Eisengart | 261/107 |
| 2,032,634 | 3/1936 | Rose | 261/107 |
| 2,054,200 | 9/1936 | Langford | 261/107 |
| 2,244,792 | 6/1941 | Miller | 261/107 |
| 2,508,530 | 5/1950 | Morris | 261/107 |
| 2,680,914 | 6/1954 | Smith | 261/26 |
| 2,752,134 | 6/1956 | Paulus | 261/29 |
| 3,290,021 | 12/1966 | Blachly | 261/29 |
| 3,990,848 | 11/1976 | Corris | 239/57 |
| 4,045,523 | 8/1977 | Goettl | 261/29 |
| 4,234,526 | 11/1980 | Mackay et al. | 261/29 |
| 5,037,586 | 8/1991 | Mehrholz et al. | 261/26 |
| 5,061,405 | 10/1991 | Stanek et al. | 261/104 |

FOREIGN PATENT DOCUMENTS

| | | | |
|---|---|---|---|
| 858467 | 12/1952 | Fed. Rep. of Germany | 261/107 |
| 2618315 | 11/1977 | Fed. Rep. of Germany | 261/104 |
| 3507544 | 9/1986 | Fed. Rep. of Germany | 261/99 |
| 1261072 | 4/1961 | France | 261/107 |

*Primary Examiner*—Tim Miles

*Attorney, Agent, or Firm*—John E. Toupal; Harold G. Jarcho

[57] ABSTRACT

A humidifier including a base defining a reservoir for retaining a liquid volume; an electrically energized humidification mechanism for inducing dispersion of liquid contained by said reservoir; an electrical supply for supplying electrical energy to the humidification mechanism; an electrical switch coupled between the supply and the humidification mechanism and having active and inactive states, the switch adapted in its active state to allow the supply of electrical energy to the humidification mechanism and adapted in its inactive state to prevent the supply of electrical energy thereto; and an operator coupled to the electrical switch and adapted for movement between active and inactive positions, the operator adapted in its active position to induce the active state of the electrical switch and in its inactive position to induce the inactive state thereof. Also included is a float disposed in the reservoir and adapted for movement in response to changes in the level of liquid therein, the float comprising an actuator portion for inducing movement of the operator and having a cross-section of given shape; and a barrier wall limiting access to the electrical switch and defining an opening conforming to the given shape, the opening receiving the actuator portion and accommodating movement thereof. The barrier wall prevents tampering operations with the electrical switch.

21 Claims, 3 Drawing Sheets

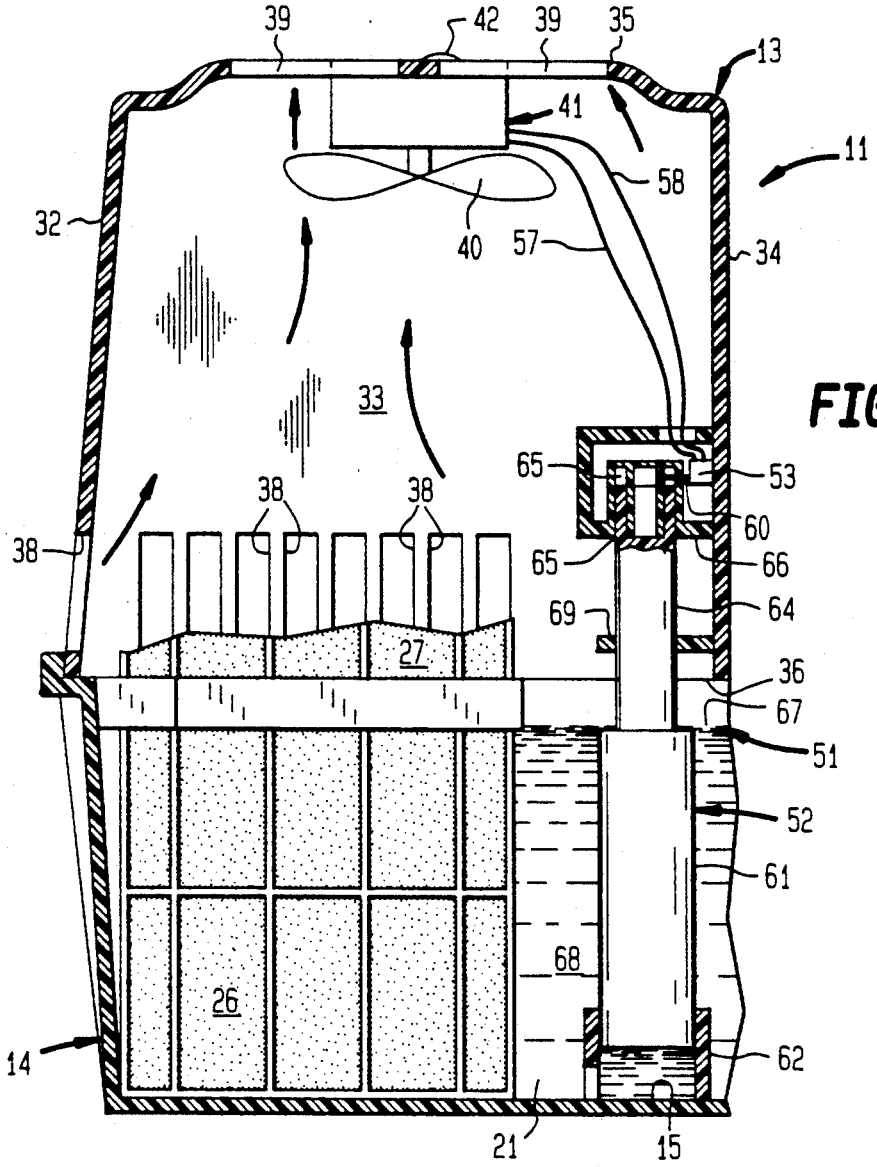
FIG. 4
FIG. 2
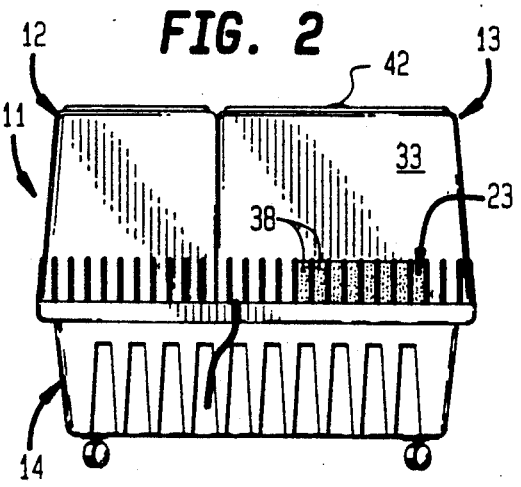

HUMIDIFIER WITH A TAMPER PROOF LIQUID LEVEL RESPONSIVE SHUT-OFF

BACKGROUND OF THE INVENTION

This invention relates generally to humidifiers and, more particularly, to a humidifier with a tamper proof liquid level responsive shut-off.

Various types of humidifiers are used to increase the humidity in a living environment. Such humidifiers use a variety of different output mechanisms to disperse from a supply reservoir water which has been preconditioned by, for example, atomization, evaporation or vaporization. In the interest of energy conservation and safety, many humidifiers are equipped with control systems that deenergize an electrical output mechanism in response to the exhaustion of the unit's water supply. Although providing a desired shut-off function, prior liquid level responsive control systems have exhibited various individual and collective deficiencies such as high cost, irratic performance, and cumbersome design configurations. An improved float responsive humidifier shut-off system is disclosed in U.S. patent application Ser. No. 07/697,550. In that system, a switch unit is protected from possible damage or inadvertent operation after removal of a demountable output mechanism. However, after demounting of the output mechanism, undesirable energization thereof can be initiated by certain tampering operations.

The object of this invention, therefore, is to provide a humidifier with an improved tamper proof control system for deenergizing an electrically operated output mechanism in response to an absence of a sufficient volume of water in a supply reservoir.

SUMMARY OF THE INVENTION

The invention is a humidifier including a base defining a reservoir for retaining a liquid volume; an electrically energized humidification mechanism for inducing dispersion of liquid contained by said reservoir; an electrical supply for supplying electrical energy to the humidification mechanism; an electrical switch coupled between the supply and the humidification mechanism and having active and inactive states, the switch adapted in its active state to allow the supply of electrical energy to the humidification mechanism and adapted in its inactive state to prevent the supply of electrical energy thereto; and an operator coupled to the electrical switch and adapted for movement between active and inactive positions, the operator adapted in its active position to induce the active state of the electrical switch and in its inactive position to induce the inactive state thereof. Also included is a float disposed in the reservoir and adapted for movement in response to changes in the level of liquid therein, the float comprising an actuator portion for inducing movement of the operator and having a cross-section of given shape; and a barrier wall limiting access to the electrical switch and defining an opening conforming to the given shape, the opening receiving the actuator portion and accommodating movement thereof. The barrier wall prevents tampering operations with the electrical switch.

According to one feature, the humidifier also includes a housing removably supported by the base, retaining the humidification mechanism and the switch, and comprising the barrier wall. The barrier wall prevents tampering even after removal of the housing from the base.

According to other features of the invention, the actuator portion and the opening are annular, and the annular opening has a maximum width less than 0.25 inches and a length of at least 3 inches. The compatible annular actuator portion and opening facilitate structural integrity of the sensing unit and prevent switch actuation by a probe shorter than 3 inches or with a diameter greater than 0.25 inches.

According to still other features of the invention, the actuator portion is a hollow cylinder, the barrier wall defines a cylindrical recess communicating with the opening, the hollow cylinder is shaped and arranged to extend through the annular opening into the cylindrical recess, and the operator is disposed within the cylindrical recess and adapted to be moved into its active position by engagement with the cylindrical portion. This arrangement facilitates part alignment during assembly of the sensing unit.

DESCRIPTION OF THE DRAWINGS

These and other objects and features of the invention will become more apparent upon a perusal of the following description taken in conjunction with the accompanying drawings wherein:

FIG. 2 is a rear elevational view of the humidifier shown in FIG. 1;

FIG. 4 is a cross-sectional view taken along lines 4—4 of FIG. 1;

DESCRIPTION OF THE PREFERRED EMBODIMENT

Figure 1:
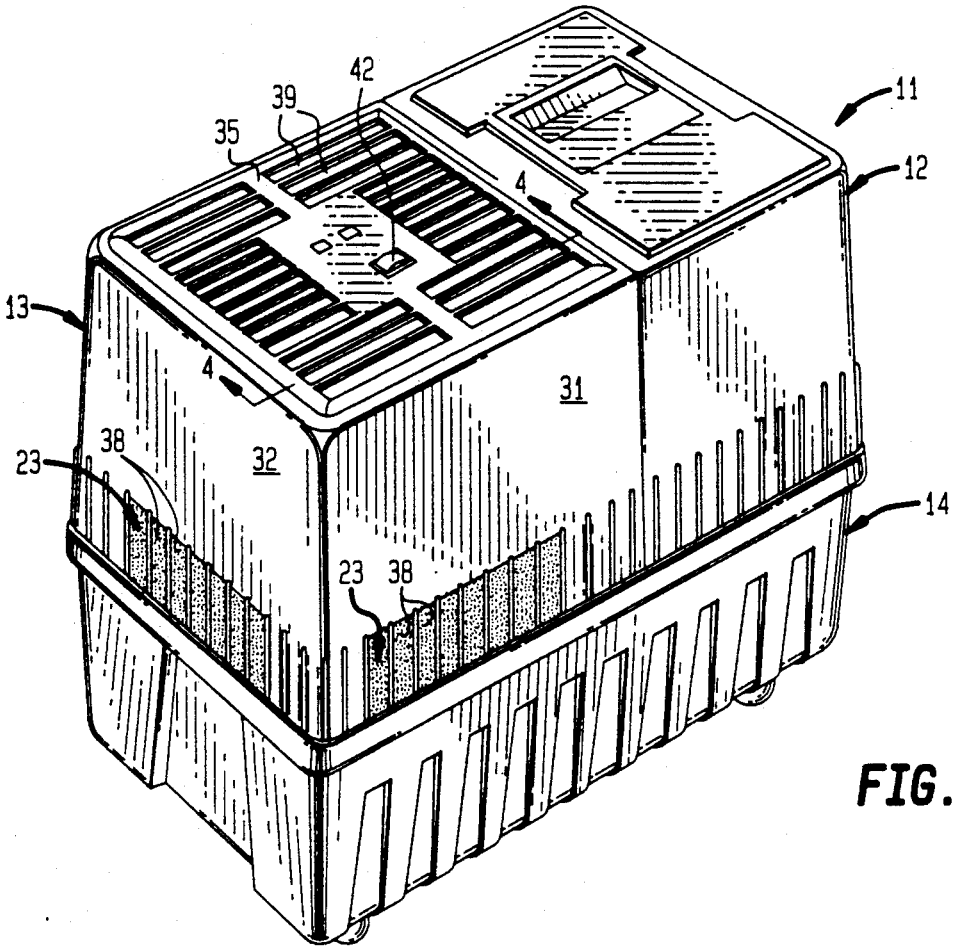
FIG. 1 is a front perspective view of a portable humidifier according to the invention.

A humidifier unit 11 includes a water storage tank 12 and an evaporator housing 13 supported in juxtaposition on a base 14. As shown most clearly in FIG. 3, the base 14 includes a bottom wall 15 and side walls 16–19 that together define a reservoir 21. Projecting inwardly from each of the base side walls 16–18 in a region below the evaporator housing 13 is a rectangularly shaped, horizontally oriented bracket 22. Each of the brackets 22 retains a wick element 23 having a framework 24 forming a plurality of compartments each filled with a suitable absorbent capillary wick material 25. A lower supply portion 26 of each wick element 23 is positioned below its horizontal retaining bracket 22 within the reservoir 21 while an upper evaporation portion 27 thereof is disposed above its bracket 22 and above the reservoir 21. Projecting upwardly from the bottom 15 of the base 14 is a stem 28, the purpose of which is described hereinafter.

The evaporator housing 13 is formed by side walls 31–34 and a top wall 35 and has an open bottom end 36 opening into the reservoir 21. Supporting the bottom end 36 of the housing 13 is an internal shoulder 37 on the base 14. The housing side walls 31–33 are aligned with and directly above, respectively, the base side walls 16–18. Formed in lower portions of each of the housing side walls 31–33 are a plurality of inlet opening slots 38 while a plurality of discharge opening slots 39 are formed in the top wall 35. The interior of the evaporator housing 13 forms parallel air flow paths extending between the inlet slots 38 in each of the housing side walls 31–33 and the discharge slots 39 in the top wall 35. Supported by the top wall 35 and extending into the evaporator housing 13 is a blower assembly including a fan 40 and drive motor 41 that is controlled by a manually operated switch 42.

Figure 6:
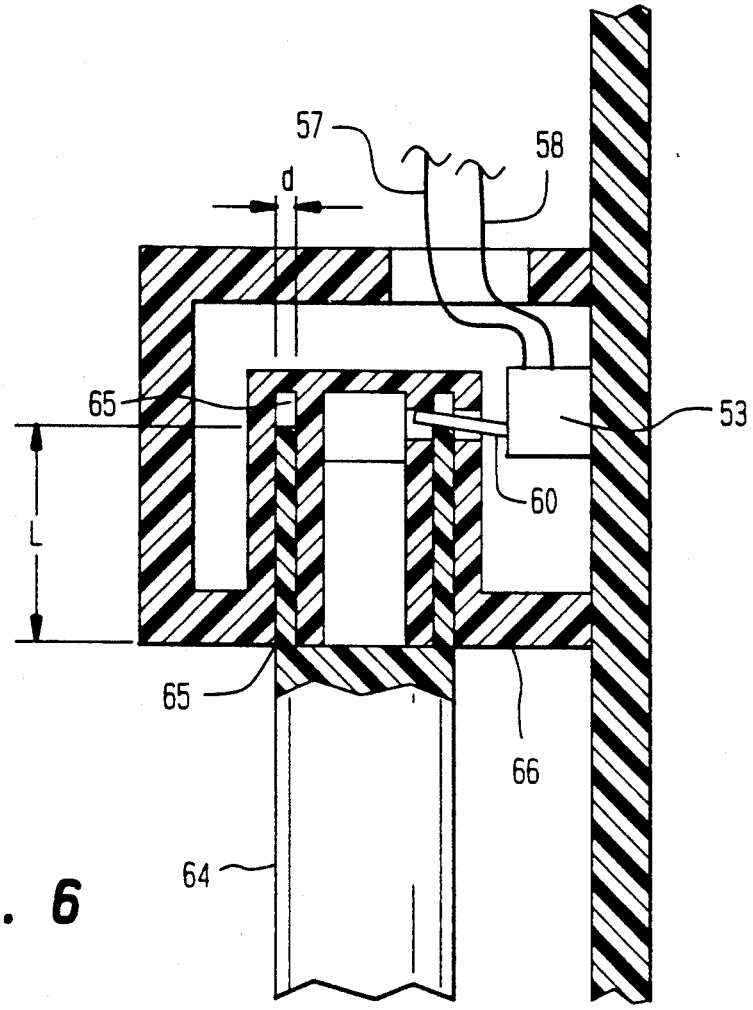
FIG. 6 is a detailed view of a float actuated operator assembly shown in FIG. 4.

As illustrated in FIG. 4 the humidifier 11 is provided with liquid level responsive shut-off system 51. Included in the system 51 is an elongated, buoyant float element 52 and an electrical on-off switch 53 actuated thereby. The switch 53 is enclosed in a housing 56 supported by the sidewall 34 of the evaporator housing 13. Connecting the electrical switch 53 and the manually operated switch 42 to the motor 41 are electrical leads 57, 58. Preferably, the switch 53 is of a conventional type that is internally biased into an inactive open state but can be moved into an active closed state by an operator lever arm 60. Retaining a buoyant lower end 61 of the float element 52 is a receptacle 62 extending upwardly from the bottom wall 15 of the base 14. The upper opposite end of the float element 52 forms an actuator portion 64 having the shape of a hollow cylinder. An annular cross-section of the cylindrical actuator portion preferably has a uniform width d of less than 0.25 inches. Receiving the actuator portion 64 is a conforming opening formed by cylindrical recess portion 65 of a barrier wall portion 66 of the housing 55. An opening 70 through an upper portion of the recess 65 receives the operator arm 60. Preferably, the annular recess 65 has a maximum width less than 0.25 inches so as to prevent access of a tampering probe larger than 0.25 inches. Also the spacing L (FIG. 6) between the mouth of the recess 65 and the operator arm 60 is preferably greater than 3 inches so as to preclude activation thereof by a probe shorter than 3 inches.

In response to changes in the level of an upper surface 67 of a liquid volume 68 in the reservoir 21, the buoyant float element 52 moves either upwardly or downwardly in a path guided by a guide bracket 69 supported by the sidewall 34 of the evaporator housing 13. With the upper surface 67 of the liquid volume 68 above a predetermined level, the actuator portion 64 of the float element 52 is moved into an active position engaging the operator arm 60 and moving the switch 53 into its active closed state. However, at levels of the upper surface 67 less than the predetermined level, the element 52 floats downwardly to move the actuator portion 64 into an inactive position that eliminates forcible engagement with the operator arm 60. The switch 53 is thereby induced into its inactive open state. Also, regardless of the level of the upper surface 67 of the liquid volume 68, relative separating movement between the actuator portion 64 of the float element 52 and the switch 53 resulting from removal of the evaporation housing 13 from the base 14 will cause the switch 53 to assume its inactive open state.

OPERATION

To prepare the humidifier 11 for use, the tank 12 is removed from the base 14 and the reservoir 21 is filled with water. In addition, the tank 12 is filled and then inverted and positioned on the base 14. Water from the tank 12 flows through a control valve (not shown) into the reservoir 21. As long as a supply of water exists in the tank 12, the upper surface 67 of the water volume 68 is retained at a desired level. Operation of the supply tank 12 is conventional and a disclosure thereof appears, for example, in U.S. Pat. No. 5,034,162.

Figure 3:
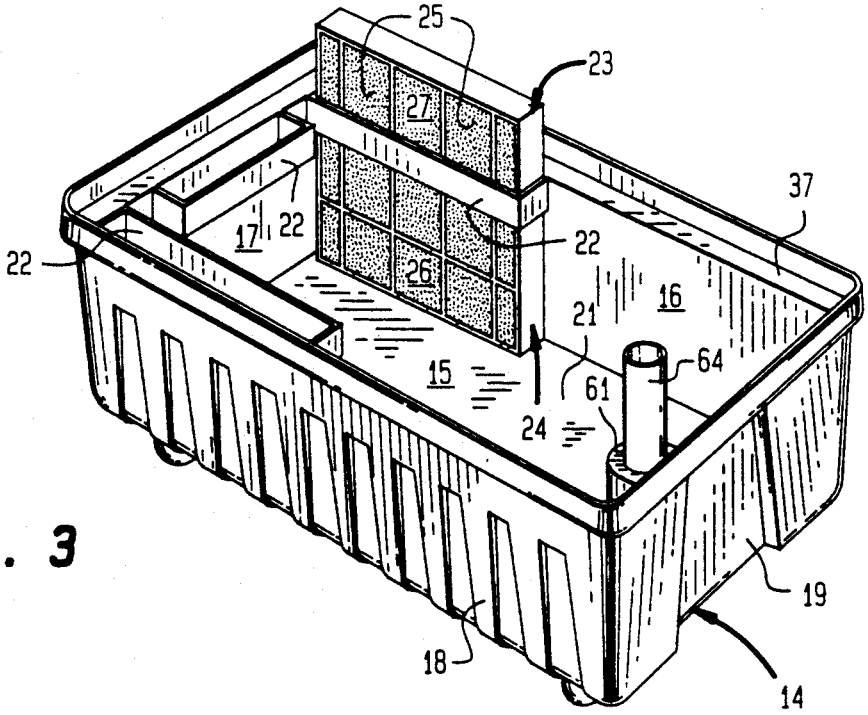
FIG. 3 is a rear perspective view of a base unit of the humidifier shown in FIG. 1.

Prior to initiating operation of the humidifier unit 11, one of the wick elements 23 is appropriately positioned within each of the brackets 22 on the base 14 after removal of the housing 13. As shown in FIG. 3, with the wick element 23 properly positioned, its supply portion 26 includes an outer surface disposed directly adjacent and parallel to the base side wall 16. Also an outer surface of the evaporator portion 27 of the wick element 23 is disposed directly adjacent and parallel to the inlet slots 38 formed in the housing side wall 31. Although for reasons of clarity, only a single wick element 23 is shown in FIG. 3, it will be understood that an identical wick element will be similarly positioned in each of the brackets 22. Consequently, the supply portion of each wick element 23 will be below the upper surface 67 of the water volume 68 in the reservoir 21 while the evaporator portion 27 of each element 23 will lie above that level and directly in an air flow path between one set of the inlet slots 38 and the discharge slots 39.

Figure 5:
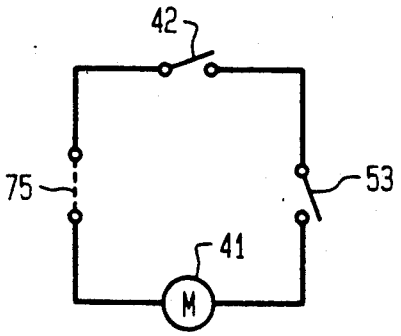
FIG. 5 is a schematic circuit diagram of a control circuit used in the humidifier shown in FIGS. 1–4.

Activation of the fan 40 is established by closing the manual switch 42 shown in FIG. 5. With the water surface 67 above a predetermined level, the float element 52 maintains the actuator portion 64 in operative engagement with the operator arm 60 to close the switch 53 and complete a circuit between a voltage supply 75 and the motor 41. Resultant current flow through the closed manual switch 42 energizes the motor 41 to produce rotation of the fan 40.

In response to a decrease of water volume 68 that brings the surface 67 below a predetermined level, the float element 52 moves downwardly into an inactive position that eliminates operative engagement between the actuator portion 64 and the operator arm 60. The resultant opening of the electrical switch 53 prevents the flow of electrical energy between the supply 75 and the motor 41 to thereby deactivate the fan 40.

Obviously, many modifications and variations of the present invention are possible in light of the above teachings. It is to be understood, therefore, that the invention can be practiced otherwise than as specifically described.

What is claimed is:

1. A humidifier comprising:

base means defining a reservoir for retaining a liquid volume;

electrically energized humidification means for inducing dispersion of liquid contained by said reservoir;

electrical supply means for supplying electrical energy to said humidification means;

electrical switch means coupled between said supply means and said humidification means and having active and inactive states, said switch means adapted in said active state to allow said supply of electrical energy to said humidification means and adapted in said inactive state to prevent said supply of electrical energy to said humidification means;

operator means coupled to said electrical switch means and adapted for movement between active and inactive positions, said operator means adapted in said active position to induce said active state of said electrical switch means and in said inactive position to induce said inactive state of said electrical switch means;

float means disposed in said reservoir and adapted for movement in response to changes in the level of liquid therein, said float means comprising an actuator portion for inducing said movement of said operator means and having a cross-section of given shape; and wall means limiting access to said electrical switch means and defining an opening conforming to said given shape, said opening receiving said actuator portion and accommodating movement thereof.

2. A humidifier according to claim 1 including a housing means removably supported by said base means, retaining said humidification means and said switch means, and comprising said wall means.

3. A humidifier according to claim 2 wherein said opening is dimensioned to prevent passage of a probe having a diameter of greater than 0.25 inches.

4. A humidifier according to claim 3 wherein said actuator portion and said openings are annular.

5. A humidifier according to claim 4 wherein said annular opening has a maximum width less than 0.25 inches.

6. A humidifier according to claim 5 wherein said actuator portion is a hollow cylinder, said wall means defines a cylindrical recess communicating with said opening, and said hollow cylinder is shaped and arranged to extend through said annular opening into said cylindrical recess.

7. A humidifier according to claim 6 wherein said operator means is disposed within said cylindrical recess and adapted to be moved into said active position by engagement with said cylindrical portion.

8. A humidifier according to claim 7 wherein said switch means comprises an on-off switch, and said operator means comprises an operator arm for operating said on-off switch.

9. A humidifier according to claim 1 wherein said actuator portion and said openings are annular.

10. A humidifier according to claim 9 wherein said annular opening has a maximum width less than 0.25 inches.

11. A humidifier according to claim 10 wherein said actuator portion is a hollow cylinder, said wall means defines a cylindrical recess communicating with said opening, and said hollow cylinder is shaped and arranged to extend through said annular opening into said cylindrical recess.

12. A humidifier according to claim 11 wherein said operator means is disposed within said cylindrical recess and adapted to be moved into said active position by engagement with said cylindrical portion.

13. A humidifier according to claim 12 wherein said switch means comprises an on-off switch, and said operator means comprises an operator arm for operating said on-off switch.

14. Electrical humidifier apparatus comprising:

base means;

electrically energized means removably mounted on said base means;

electrical supply means for supplying electrical energy to said electrically energized means;

electrical switch means coupled between said supply means and said electrically energized means and having active and inactive states, said switch means adapted in said active state to allow said supply of electrical energy to said electrically energized means and adapted in said inactive state to prevent said supply of electrical energy to said electrically energized means;

operator means coupled to said electrical switch means and adapted for movement between active and inactive positions, said operator means adapted in said active position to induce said active state of said electrical switch means and in said inactive position to induce said inactive state of said electrical switch means;

actuator means disposed on said base means and comprising an annular actuator portion for inducing said movement of said operator means in response to relative movement between said base means and said electrically energized means, said actuator portion having a cross-section of given shape; and wall means limiting access to said electrical switch means and defining an annular opening conforming to said given shape, said opening receiving said actuator portion and accommodating movement thereof relative to said electrically energized means.

15. A humidifier according to claim 14 wherein said opening is dimensional to prevent passage of a probe having a diameter of greater than 0.25 inches.

16. A humidifier according to claim 15 wherein said annular opening has a maximum width less than 0.25 inches.

17. A humidifier according to claim 16 wherein said actuator portion is a hollow cylinder, said wall means defines a cylindrical recess communicating with said opening, and said hollow cylinder is shaped and arranged to extend through said annular opening into said cylindrical recess.

18. A humidifier according to claim 17 wherein said operator means is disposed within said cylindrical recess and adapted to be moved into said active position by engagement with said cylindrical portion.

19. A humidifier according to claim 18 wherein said switch means comprises an on-off switch, and said operator means comprises an operator arm for operating said on-off switch

20. A humidifier according to claim 14 wherein said actuator portion is a hollow cylinder, said wall means defines a cylindrical recess communicating with said opening, and said hollow cylinder is shaped and arranged to extend through said annular opening into said cylindrical recess.

21. A humidifier according to claim 14 wherein said wall means and said switch means are shaped and arranged to prevent actuation thereof by a probe having a length less than 3 inches.

* * * * *